US006831611B2

(12) United States Patent
Ooe et al.

(10) Patent No.: US 6,831,611 B2
(45) Date of Patent: Dec. 14, 2004

(54) ANTENNA SYSTEM

(75) Inventors: Junzo Ooe, Nishikamo-gun (JP); Kansei Mizutani, Nisshin (JP); Kazuo Sato, Seto (JP); Shin-ichiro Matsuzawa, Nisshin (JP); Kunitoshi Nishikawa, Motosu-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 12 days.

(21) Appl. No.: 10/354,995

(22) Filed: Jan. 31, 2003

(65) Prior Publication Data

US 2003/0156069 A1 Aug. 21, 2003

(30) Foreign Application Priority Data

Feb. 15, 2002 (JP) ..... 2002-039005

(51) Int. Cl.[7] ..... H01Q 1/32; H01Q 1/28
(52) U.S. Cl. ..... 343/713; 343/711; 343/714
(58) Field of Search ..... 343/895, 797, 343/795, 747, 854, 876, 806, 712–714, 821, 778, 754, 700 MS

(56) References Cited

U.S. PATENT DOCUMENTS 3,925,784 A * 12/1975 Phelan ..... 343/754
3,949,407 A * 4/1976 Jagdmann et al. ..... 343/895
4,193,077 A * 3/1980 Greenberg et al. ..... 343/747
4,334,230 A * 6/1982 Kane ..... 343/797
5,434,557 A * 7/1995 Alizi ..... 340/555
5,453,752 A * 9/1995 Wang et al. ..... 343/700 MS
5,896,113 A * 4/1999 O'Neill, Jr. ..... 343/895
5,936,595 A * 8/1999 Wang ..... 343/895
6,078,791 A * 6/2000 Tuttle et al. ..... 455/90.1
6,094,166 A * 7/2000 Martek et al. ..... 342/374
6,342,867 B1 * 1/2002 Bell ..... 343/795
6,400,325 B2 * 6/2002 Aaltonen ..... 343/711
6,642,889 B1 * 11/2003 McGrath ..... 343/700 MS

FOREIGN PATENT DOCUMENTS

JP A 2000-252895 9/2000

* cited by examiner

*Primary Examiner*—Don Wong
*Assistant Examiner*—Chuc Tran
(74) *Attorney, Agent, or Firm*—Oliff & Berridge, PLC

(57) ABSTRACT

The invention is an antenna system that transmits and receives image signals audio signal and/or data signals. The antenna system has at least one antenna element and one or more power supply elements. A power supply switching device switches the power supply element or elements to select at least one antenna element and a power supply cable supplies power to the power supply switching device.

15 Claims, 10 Drawing Sheets

ANTENNA SYSTEM

INCORPORATION BY REFERENCE

The disclosure of Japanese Patent Application No. 2002-039005 filed on Feb. 15, 2002 including the specification, drawings and abstract is incorporated herein by reference in its entirety.

BACKGROUND OF THE INVENTION

1. Field of Invention

The invention relates to an antenna system capable of transmitting and receiving radio waves with high sensitivity by switching antenna elements, and more particularly to an antenna system which changes its directivity by switching power supply elements through which power is supplied to the antenna elements by means of a power supply switching device so as to maintain sufficient sensitivity. The invention may be employed as an antenna system for, for example, in-vehicle radio systems, in-vehicle TV signal receiving systems, and vehicle-to-vehicle communication systems.

2. Description of Related Art

A known antenna system mounted on a motor vehicle is shown in FIG. 10. This antenna system is an in-vehicle FM/TV antenna system, which includes four antenna elements 1*a*, 1*b*, 1*c*, and 1*d* formed or arranged within rear-side glass windows 2, RF amplifiers 3, 4 and coaxial cables 5 provided in power supply portions for respective pairs of the antenna elements 1*a*, 1*b* and 1*c*, 1*d*, and a receiver 6 including an antenna element switching device. With the antenna system thus constructed, radio waves are received by the antenna elements 1*a*, 1*b*, 1*c*, and 1*d* that are disposed separated from each other, and the thus received radio waves are amplified by the RF amplifiers 3, 4 that are also disposed separated from each other. The amplified radio waves are then converged while being supplied to the receiver 6 via the coaxial cables 5. Here, the receiver 6 is adapted to select one of the antenna elements which is supplying the highest level of power. Thus, the antenna system is able to receive radio waves while maintaining high sensitivity, such as airwaves, by selecting the most appropriate antenna element. Also, the antenna system constructed as described above can be installed in a motor vehicle without its antenna protruding out from the vehicle body.

As shown in FIG. 10, the antenna elements 1*a*, 1*b* (1*c*, 1*d*) are arranged close to each other in the same direction. With this arrangement, however, when switching the antenna elements, the directivity of the antenna system only changes slightly. As shown in FIGS. 11*a* and 11*b*, it hardly changes. Also, since the sensitivity of the antenna system changes as the vehicle changes its direction, it may happen, depending on the direction of the vehicle, that receiving of radio waves becomes unstable. In addition, since the antenna system essentially includes two RF amplifiers 3, 4 arranged in right and left sides respectively and four coaxial cables 5, this may cause an increase in the cost of the antenna system owing to complicated work required for assembling such parts, high cost for the many parts, and so on.

SUMMARY OF THE INVENTION

It is therefore an object of this invention to provide an antenna system which includes at least one antenna element, a plurality of power supply elements, and a power supply switching device, and which is capable of transmitting and receiving radio waves while maintaining sufficient sensitivity by changing the directivity by switching the power supply elements.

To achieve the above object, an antenna system according to one aspect of the invention is provided as an antenna system for emitting/receiving radio waves carrying image signals, audio signals, and/or data signals, and is mainly constituted by at least one antenna element, a plurality of power supply elements through each of which, power is supplied to the antenna element, a power supply switching device, and a power supply cable connected to the power supply switching device. The power supply switching device is operable to switch the power supply elements to connect a selected one or more of the antenna elements to the power supply cable. In the antenna system, a single antenna element or a plurality of antenna elements may be provided. That is, when a plurality of antenna elements are provided, the switches of the power supply switching device are turned on/off to select a specific one or more of the antenna elements via a corresponding one or more of the power supply elements. When a single antenna element is provided, the switches are turned on/off to select a specific one or more of a plurality of routes which are provided by the antenna element and the power supply elements depending on their arrangement and which serve as antenna elements.

In conventional antenna systems, such power supply connection switching is carried out between or among different sets of an antenna element, an amplifier or amplifiers connected to the antenna element, and a power supply cable, while the antenna system according to this invention merely switches the power supply elements. Therefore, unlike such a conventional antenna system, requiring a plurality of power supply cables and amplifies, the antenna system of this invention requires only a single power supply cable and amplifier, thus assuring easier work for installing the antenna system in, for example, a vehicle, and reducing its cost.

In the invention, "loop" and "loop-shaped" represent not only the shape of a closed loop, but also a loop-like shape which may have one or more portions missing.

BRIEF DESCRIPTION OF THE DRAWINGS

The foregoing and/or further objects, features and advantages of the invention will become more apparent from the following description of preferred embodiments with reference to the accompanying drawings, in which like numerals are used to represent like elements and wherein.

DETAILED DESCRIPTION OF PREFERRED EMBODIMENTS

Hereinafter, preferred embodiments of the invention will be described in detail. Meanwhile, it is to be noted that the invention is not limited to the preferred embodiments.

Figure 1:
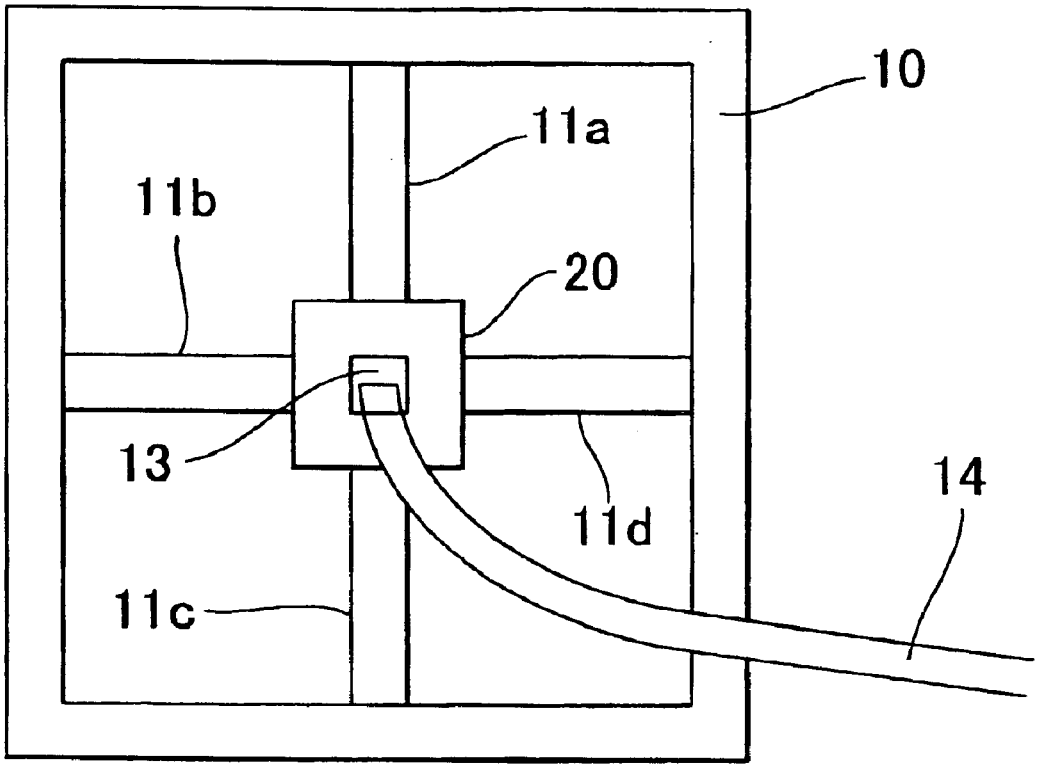
FIG. 1 is a view schematically showing the construction of an antenna system according to one embodiment of the invention.

FIG. 1 shows an antenna system according to a first embodiment of the invention, which includes a loop antenna element 10, flat-shaped power supply elements 11*a*, 11*b*, 11*c*, and 11*d*, power supply switching device 20, balun (a ferrite core) 13, and coaxial cable 14. The power supply elements 11*a* to 11*d* are disposed inside of the loop antenna element 10 and serve also as antenna elements. The power supply switching device 20 is connected to the respective power supply elements 11*a* to 11*d*. The balun 13 functions as a balance/unbalance converter, and the coaxial cable 14 serves as a power supply cable.

Figure 2:
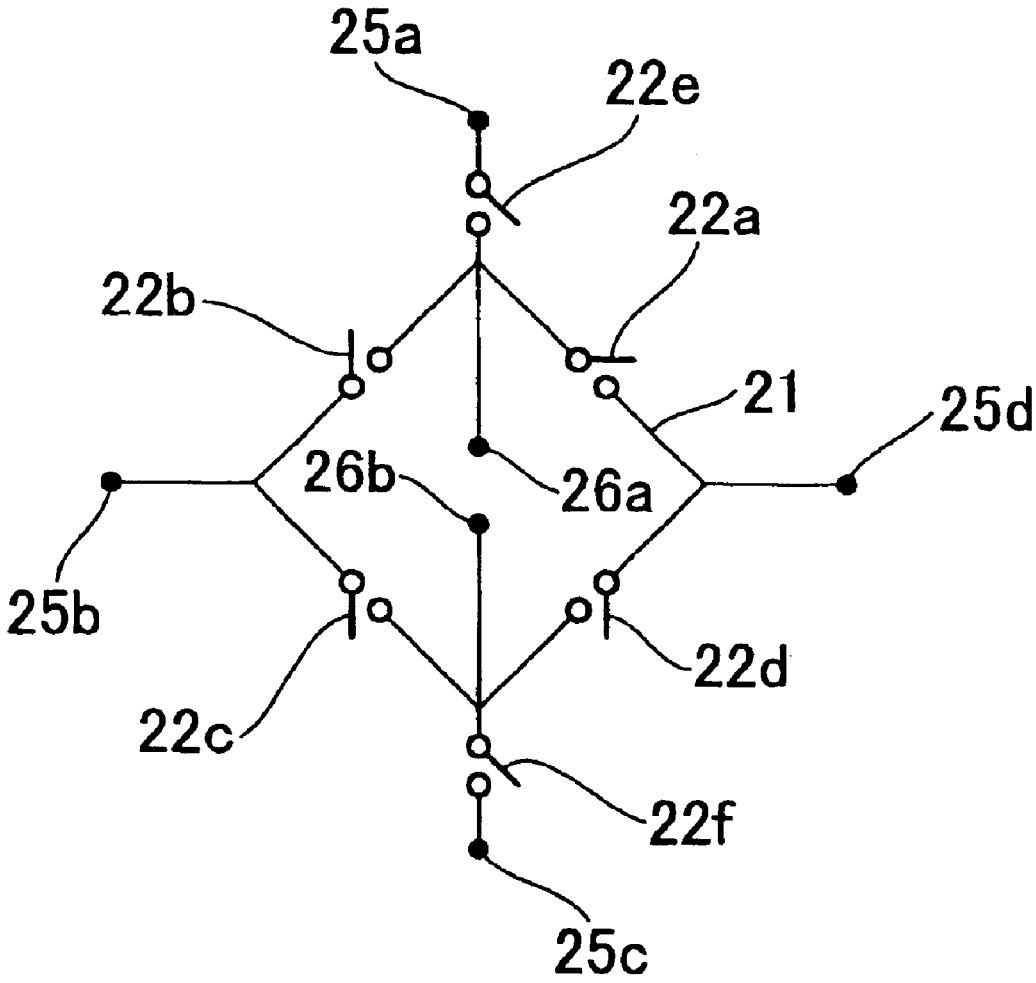
FIG. 2 is a diagram schematically showing the circuit of a power supply switching device of the antenna system shown in FIG. 1.
Figure 3:
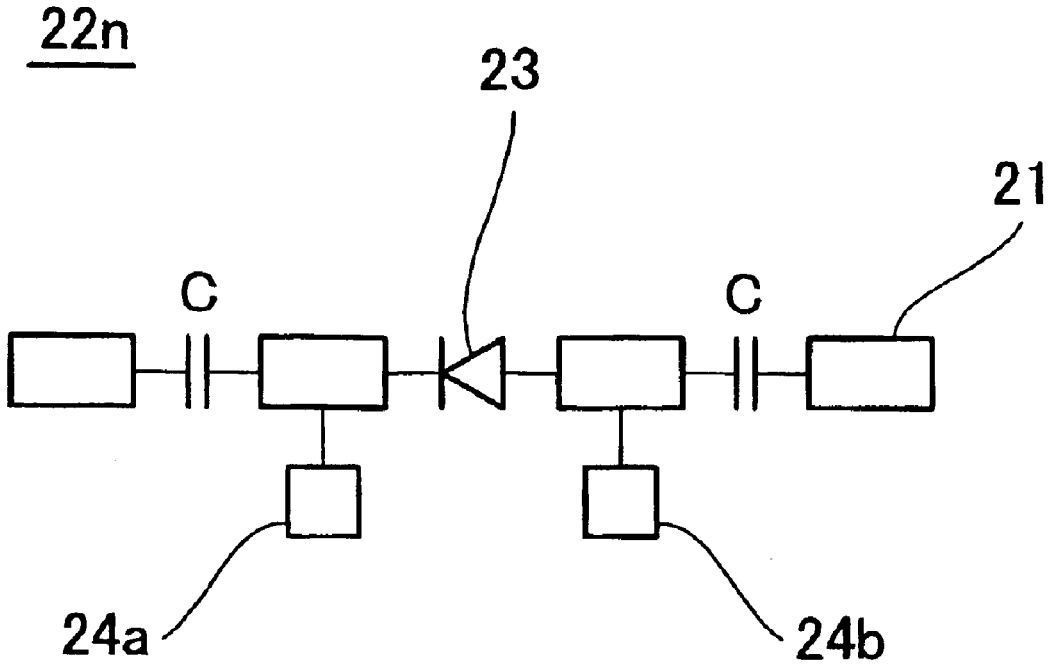
FIG. 3 is a diagram schematically showing the circuit of a switch provided in the antenna system shown in FIG. 1.

FIG. 2 shows the circuit configuration of the power supply switching device 20. The power supply switching device 20 includes a line 21, switches 22*a* to 22*f*, connecting terminals 25*a* to 25*b*, and connecting terminals 26*a*, 26*b*. The line 21 is arranged in the form of a bridge circuit. Each of the switches 22*a* to 22*f* is mainly constituted by a semiconductor element or elements and provided along the line 21. The connecting terminals 25*a* to 25*b* serve as connecting points to the power supply elements 11*a* to 11*d*, while the terminals 26*a*, 26*b* serve as connecting points to the balun 13. Each of the switches 22*a* to 22*f*, as shown in FIG. 3, includes a diode 23 and bias terminals 24*a*, 24*b*, and is arranged to be ON when forward voltage is applied between the ends of the respective bias terminals 24*a*, 24*b*, and to be OFF when reverse voltage is applied therebetween. In FIG. 2, "C" represents capacitors provided for cutting off direct current components.

Figure 4:
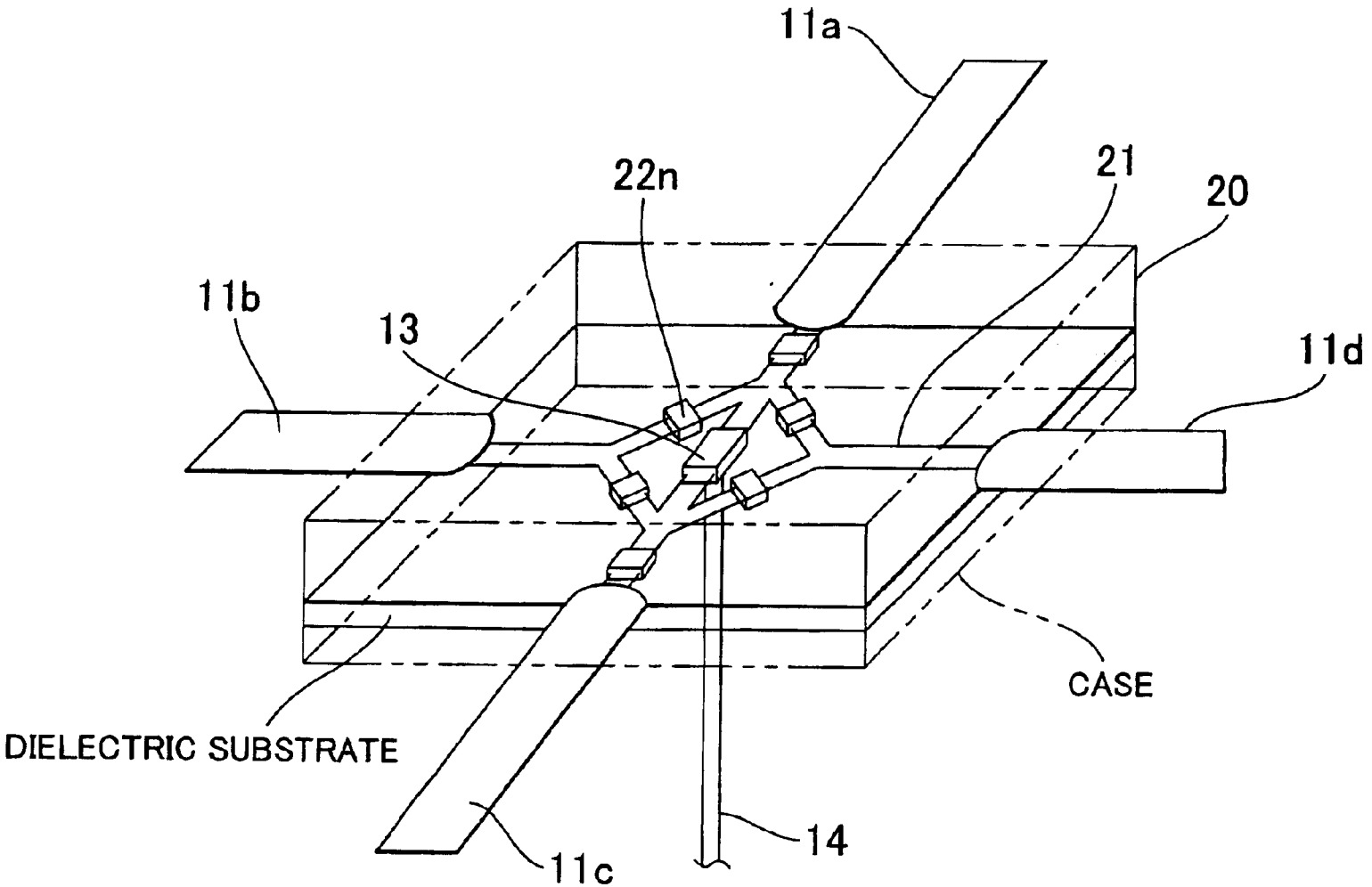
FIG. 4 is a perspective view showing the power supply switching device shown in FIG. 1, in which power supply elements, balun, and coaxial cable are connected.

FIG. 4 shows the construction of the power supply switching device 20 in which the power supply elements 11*a* to 11*d*, the balun 13, and the coaxial cable 14 are connected. These elements constituting the power supply switching device 20, as shown in FIG. 4, are arranged or formed on a case with a dielectric substrate interposed therebetween. Here, the balun 13 functions to match the impedance of the coaxial cable 14 and that of the power supply switching device 20, so as to sufficiently reduce the degree of reflectance which may occur at the power supply switching device 20. This improves the radio-wave transmitting and receiving quality of the antenna system.

Figure 5:
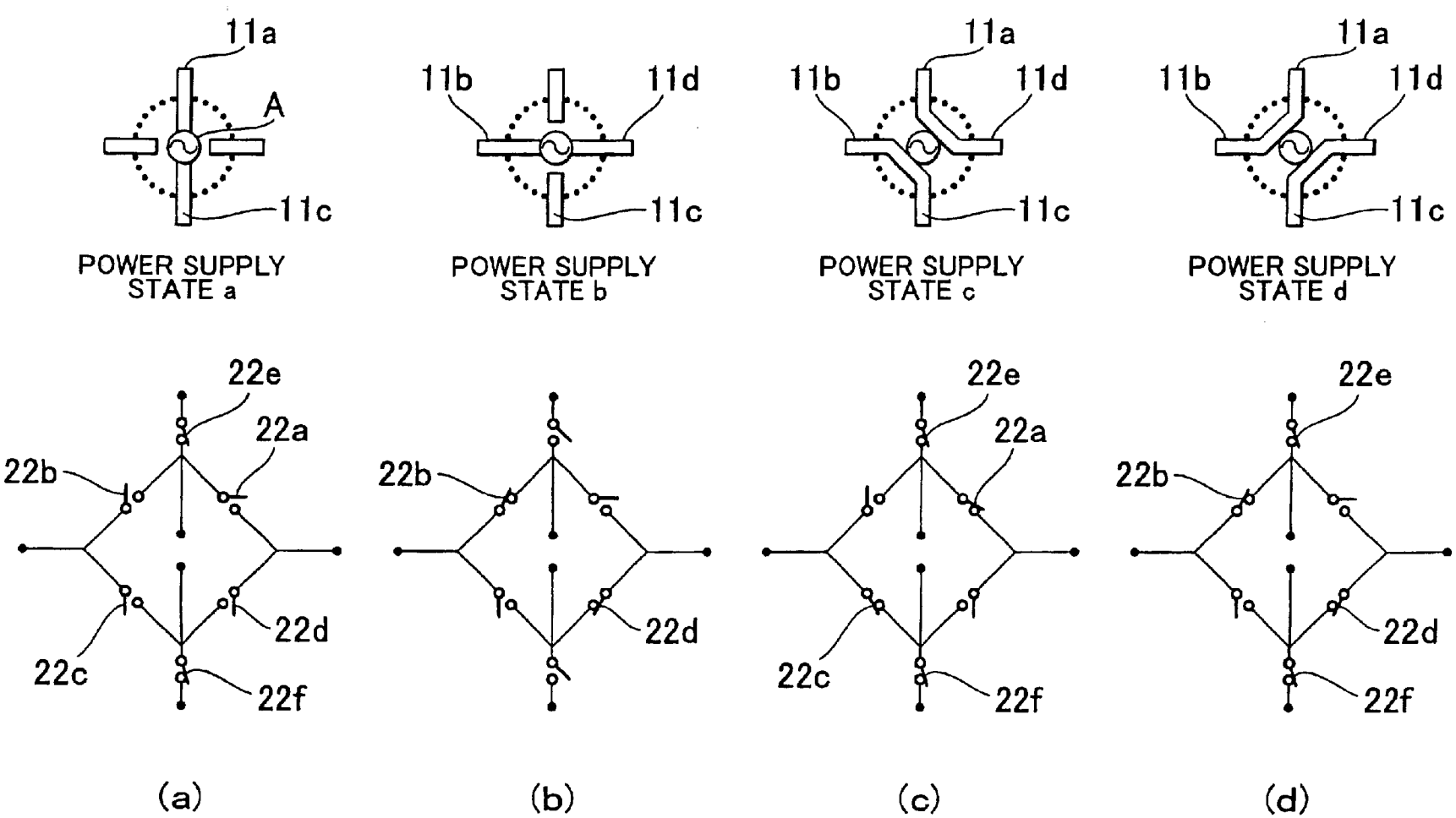
FIG. 5 is a view schematically switching states of the switches in the antenna system and corresponding power supply states.

Next, the operation of the antenna system of this embodiment will be described. Briefly, the antenna system of this embodiment is operable to obtain its directivity in four directions by selectively energizing the four power supply elements via the power supply switching device 20 including the six switches 22*a* to 22*f*. FIG. 5 shows four switching states in the power supply switching device 20 and four power supply states a, b, c, and d that are established in the respective switching states. When the switches 22*c* and 22*f* are ON and the power supply elements 11*a*, 11*c* are energized as shown in FIG. 5A, it establishes the power supply state a, providing two loop routes located in the right and left sides. When the switches 22*b* and 22*d* are ON and the power supply elements 11*b*, 11*d* are energized as shown in FIG. 5B, it establishes the power supply state b, providing two loop routes located in the upper and lower sides. When the switches 22*e*, 22*f*, 22*a*, and 22*c* are ON, as shown in FIG. 5C, it establishes the power supply state c, providing two loop routes located in the upper-left and lower-right sides. When the switches 22*e*, 22*f*, 22*b*, and 22*d* are ON, as shown in FIG. 5D, it establishes the power supply state d, providing two loop routes located in upper-right and lower-left sides. In FIG. 5, a point "A" represents the power supply point.

Figure 6:
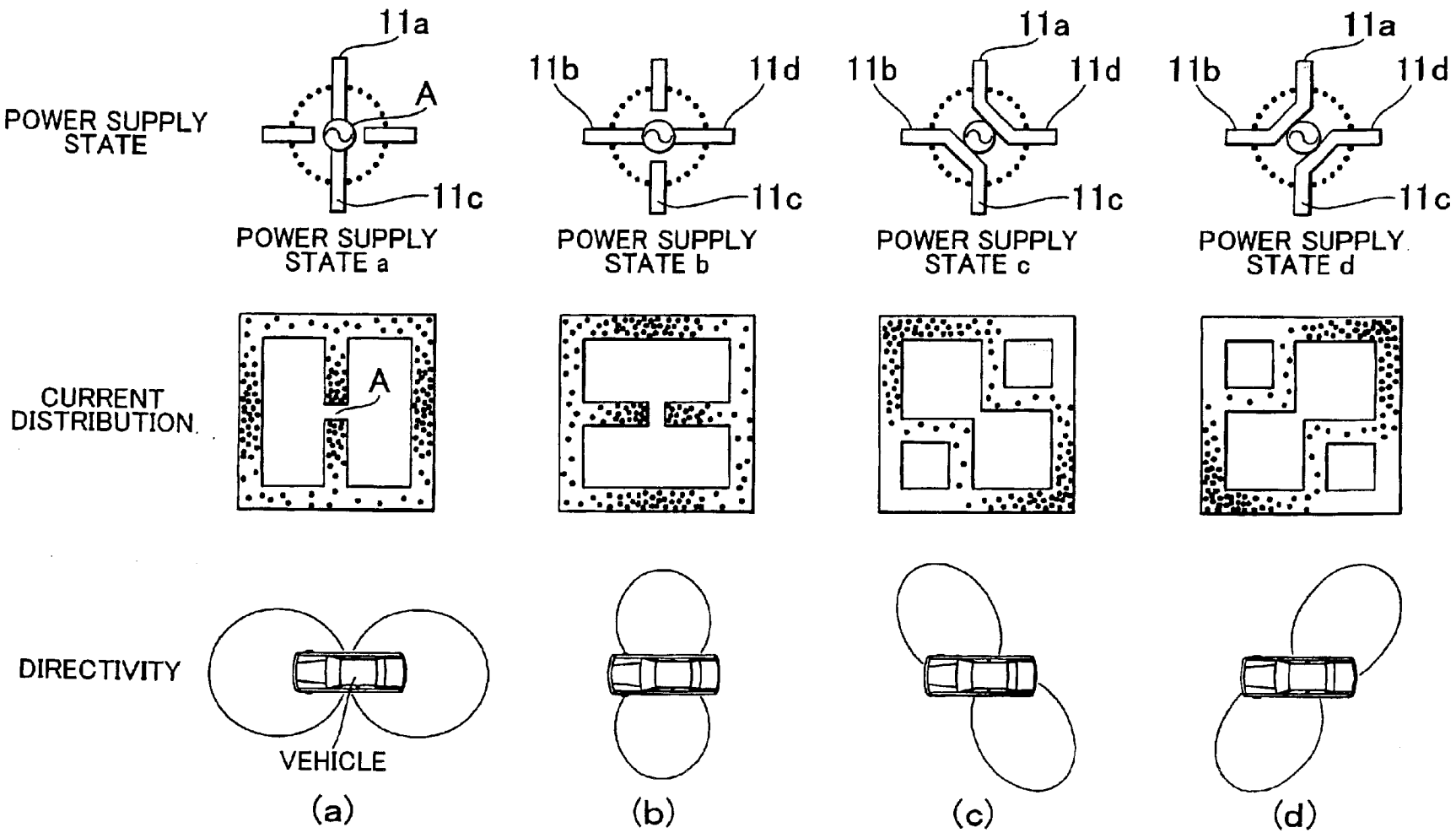
FIG. 6 is a view schematically showing power supply states, corresponding current distributions, and corresponding directivities.

FIG. 6 schematically illustrates the power supply states, and current distributions and directivities obtained in the respective power supply states, when the antenna system is installed in a roof of the vehicle body. According to the antenna system of this embodiment, as shown in FIG. 5, when switching the power supply elements by means of the power supply switching device 20, the device selects a specific one or more of the plurality of routes provided by the antenna element 10 and the power supply elements, and thereby biases the current distribution in each of the predetermined four directions. As is apparent from FIG. 6, the direction in which the directivity is weak shifts by 45 degrees, each time the power supply states are switched from one to the other. Thus, a high sensitivity can be achieved in transmitting and receiving radio waves in all directions by selectively establishing a corresponding one of the four power supply states. The antenna system of this embodiment is especially suitable for use in, for example, a movable body in which the direction for transmitting and receiving radio waves continuously changes. When used in a vehicle, for example, it is preferable to embed it in a surface portion of the vehicle body such as a resin-made roof and/or trunk lid. In this case, the antenna element may be easily formed large for achieving a desired sensitivity. Moreover, since the antenna system is embedded in such a surface portion of the vehicle body, an increase in the air resistance of the vehicle, which may otherwise be caused by the external antenna system installed therein, may be prevented, and the possibility for the antenna system to be damaged may be reduced.

Figure 7:
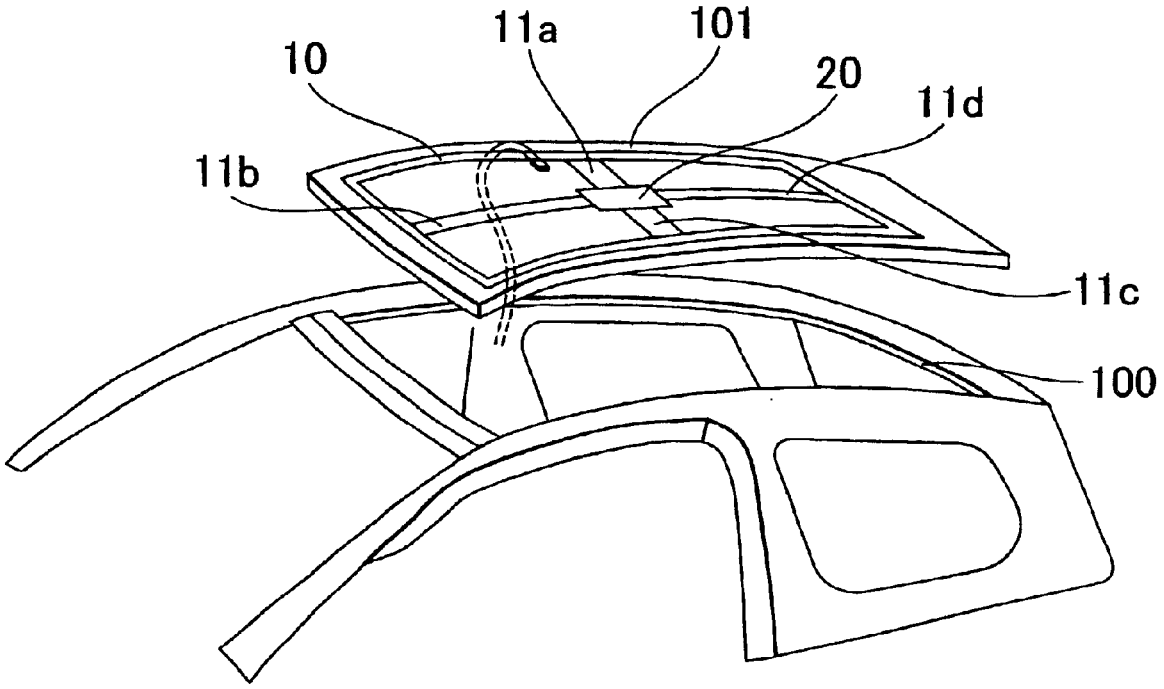
FIG. 7 is a view schematically showing an antenna system according to another embodiment of the invention and a portion of a vehicle body when the antenna system is installed in the vehicle body.

Next, a second embodiment of the invention will be described with reference to FIG. 7. In the antenna system of this embodiment, a metal frame portion 100 of a vehicle is used as a radio-wave emitting/receiving loop antenna element. More specifically, a loop antenna element 10 is provided along the inner periphery of the metal frame portion 100 of the vehicle, and the flat-shaped power supply elements 11*a*, 11*b*, 11*c*, and 11*d* are connected to the antenna element 10. The power supply switching device 20, described in the first embodiment, is arranged in a center of the loop antenna element 10 at which the four power supply elements 11*a* to 11*d* converge.

The antenna element 10 and the power supply elements 11*a* to 11*d* are fixed on the backside of a resin-made vehicle roof 101 using adhesive or the like. Thus, it is possible to produce the vehicle roof 101 and these elements in one unit. The antenna element 10 is arranged in the resin-made roof 101 such that the antenna element 10 and the metal frame portion 100 are located close enough to each other to be electromagnetically coupled by electromagnetic induction therebetween, when the resin-made roof 101 is mounted on the metal frame portion 100 of the vehicle. With the antenna system thus constructed, the directivity can be changed in the same manner as in the first embodiment shown in FIG. 6.

While the preferred embodiments of the invention have been described, it is to be understood that various modifications may be made to them. For example, while each switch of the power supply switching device is mainly constituted by a diode in the above-described embodiments, the switch may be mainly constituted or provided by another element or component, such as a single transistor, analogue switch, high frequency relay, and MEMS.

Figure 8:
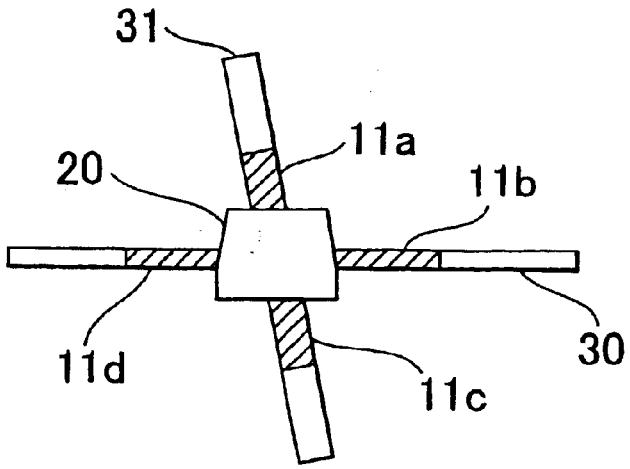
FIG. 8 is a view schematically showing the construction of an antenna system according to one modification example of the antenna system shown in FIG. 1.
Figure 9:
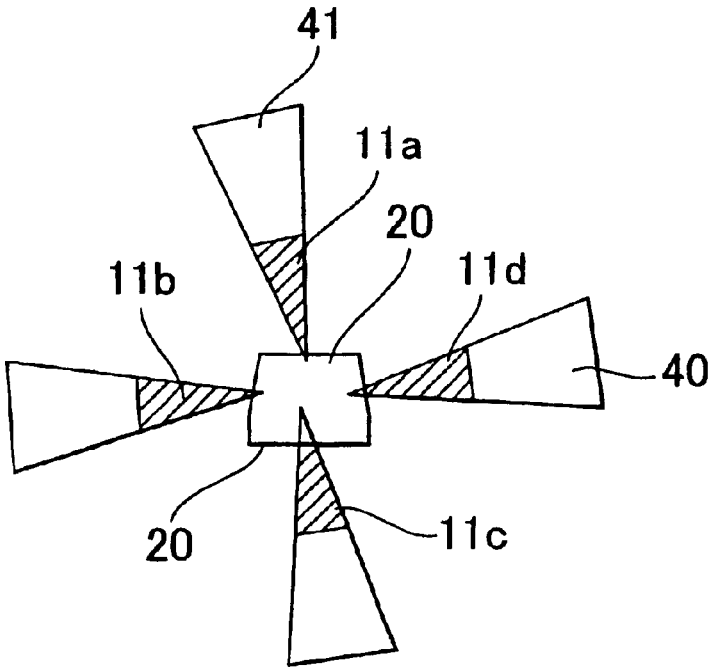
FIG. 9 is a view schematically showing the construction of an antenna system according to another modification example of the antenna system shown in FIG. 1.
Figure 10:
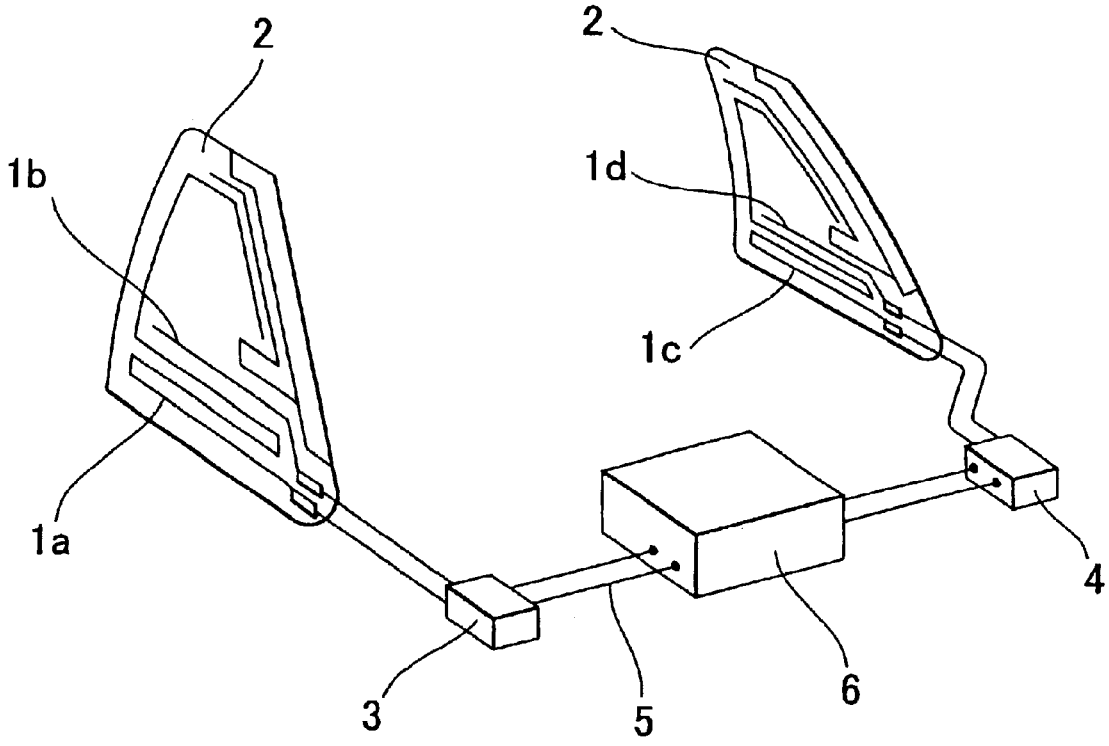
FIG. 10 is a view schematically showing the construction of a conventional antenna system.
Figure 11:
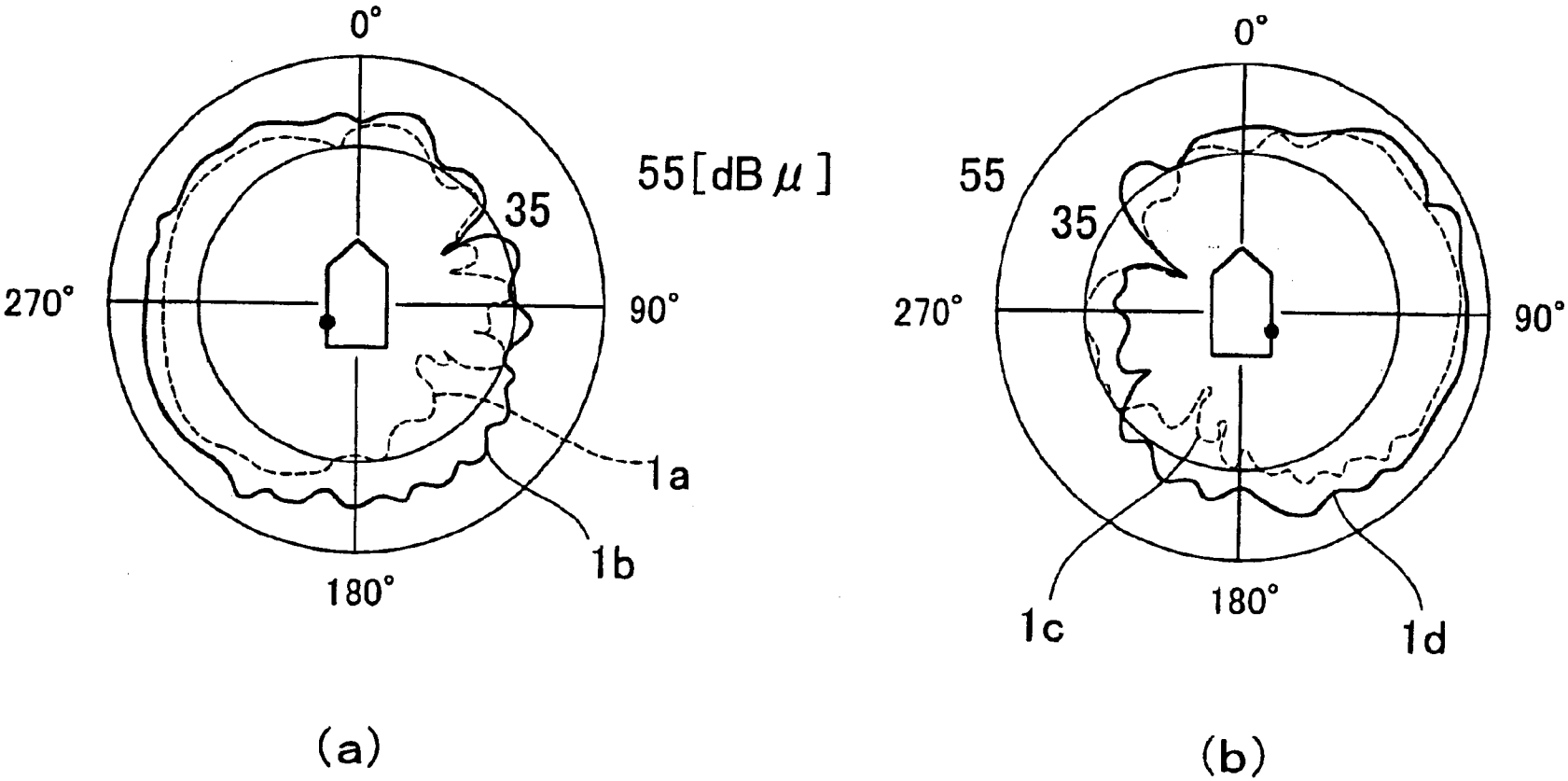
FIG. 11 is a view schematically showing the directivity characteristic of the conventional antenna system.

While the loop antenna element 10 has a square shape in the above-described embodiments, a loop antenna element having a round shape may certainly be used. Moreover, an antenna element of other type or having a different shape from a loop antenna element may be used, such as crossed dipole antenna elements 30, 31 each including the power supply elements 11*b*, 11*d* (or 11*a*, 11*c*) with the power supply switching device 20 arranged as shown in FIG. 8, and such as crossed bow-tie antenna elements 40, 41 each including the power supply elements 11*b*, 11*d* (or 11*a*, 11*c*) with the power supply switching device 20, arranged as shown in FIG. 9. Such an arrangement also enables the antenna system to maintain a sufficient directivity by using a reduced number of amplifiers and coaxial cables for the antenna system.

Also, while each of the power supply elements 11*a*, 11*b*, 11*c*, and 11*d* is connected to a center portion of each side of the antenna element 10 having a square shape in the above-described embodiments, it may be connected to other portion, deviated from the center portion. By shifting the position to which each power supply element is connected, it is possible, for example, to change the radio wave transmitting/receiving band of the antenna system. Alternatively, each of the power supply elements 11*a*, 11*b*, 11*c*, and 11*d* may be connected to each corner portion of the antenna element 10 having a square shape. In this case, other power supply states are established, thus changing the signal emitting/receiving band of the antenna system.

While the invention has been described with reference to preferred exemplary embodiments thereof, it is to be understood that the invention is not limited to the disclosed embodiments or constructions. On the contrary, the invention is intended to cover various modifications and equivalent arrangements. In addition, while the various elements of the disclosed invention are shown in various combinations and configurations, which are exemplary, other combinations and configurations, including more less or only a single element, are also within the spirit and scope of the invention.

What is claimed is:

1. An antenna system that transmits and receives at least one of an image signal, audio signal, and data signal, the antenna system comprising:

at least one antenna element:

a plurality of power supply elements for supplying power to the at least one antenna element, each of the power supply elements comprising an antenna element when supplying power to the at least one antenna element;

a power supply switching device that switches the power supply elements to select at least one predetermined antenna element from the at least one antenna element; and a power supply cable connected to the power supply switching device.

2. An antenna system that transmits and receives at least one of an image signal, audio signal, and data signal, the antenna system comprising:

at least one antenna element;

a plurality of power supply elements for supplying power to the at least one antenna element;

a power supply switching device that switches the power supply elements to select at least one predetermined antenna element from the at least one antenna element;

a power supply cable connected to the power supply switching device; and four power supply elements are provided and the power supply switching device includes six switches, and connecting points to the four power supply elements are connected in the form of a bridge circuit via four of the six switches, and each of the remaining two switches is connected in series between one of two of the connecting points that are opposite to each other and a corresponding one of the power supply elements, and the power supply cable is connected to the two connecting points, and the switches are turned on and off to switch the power supply elements to be connected to the power supply cable.

3. The antenna system according to claim 1, wherein:

the antenna element comprises a loop antenna element;

the power supply elements are arranged inside of the loop antenna element so as to form a plurality of loop routes; and at least one predetermined loop route is selected from the plurality of loop routes by switching the power supply elements.

4. The antenna system according to claim 1, wherein the antenna element comprises a crossed dipole antenna element.

5. The antenna system according to claim 1, wherein the antenna element comprises a crossed bow-tie antenna element.

6. The antenna system according to claim 2, wherein the antenna element comprises a loop antenna element, and the power supply elements are arranged inside of the loop antenna element so as to form a plurality of loop routes; and at least one predetermined loop route is selected from the plurality of loop routes by switching the power supply elements.

7. The antenna system according to claim 2, wherein the antenna element comprises a crossed dipole antenna element.

8. The antenna system according to claim 2, wherein the antenna element comprises a crossed bow-tie antenna element.

9. The antenna system according to claim 1, wherein each of the power supply elements comprises an electric conductor electrically coupled with the antenna element, which has at least one of a linear shape, a flat shape, and a bar-like shape.

10. The antenna system according to claim 1, wherein each of the switches of the power supply switching device comprises at least one semiconductor element.

11. An antenna system that transmits and receives at least one of an image signal, audio signal, and data signal, the antenna system comprising:

at least one antenna element;

a plurality of power supply elements for supplying power to the at least one antenna element;

a power supply switching device that switches the power supply elements to select at least one predetermined antenna element from the at least one antenna element;

a power supply cable connected to the power supply switching device; and a balance/unbalance converting element is provided between the power supply switching device and the power supply cable.

12. The antenna system according to claim 1, wherein the antenna element is embedded in an insulative surface of a vehicle body.

13. The antenna system according to claim 1, wherein the antenna element comprises a portion of a vehicle body.

14. The antenna system according to claim 13, wherein the portion of the vehicle body comprises a radio-wave emitting/receiving antenna element and the power supply elements are electromagnetically coupled with the radio-wave emitting/receiving antenna element.

15. An antenna system that transmits and receives at least one of an image signal, audio signal, and data signal, the antenna system comprising:

at least one antenna element comprising a portion of a vehicle body;

a plurality of power supply elements for supplying power to the at least one antenna element;

a power supply switching device that switches the power supply elements to select at least one predetermined antenna element from the at least one antenna element;

a power supply cable connected to the power supply switching device;

the portion of the vehicle body comprises a radio-wave emitting/receiving antenna element and the power supply elements are electromagnetically coupled with the radio-wave emitting/receiving antenna element; and the radio-wave emitting/receiving antenna element comprises a metal frame provided along a periphery of a resin roof of the vehicle.

* * * * *